United States Patent [19]

Denman

[11] Patent Number: 4,664,001

[45] Date of Patent: May 12, 1987

[54] TORQUE WRENCH WITH AUDIO AND VISUAL INDICATOR

[75] Inventor: Stephen A. Denman, Centerville, Ohio

[73] Assignee: Deuer Manufacturing Inc., Dayton, Ohio

[21] Appl. No.: 801,197

[22] Filed: Nov. 25, 1985

[51] Int. Cl.[4] ..... B25B 23/144

[52] U.S. Cl. ..... 81/479; 81/483; 73/1 C

[58] Field of Search ..... 81/479, 483, 477, 478, 81/467; 73/1 C, 862.08

[56] References Cited

U.S. PATENT DOCUMENTS

| | | | |
|---|---|---|---|
| 3,076,362 | 2/1963 | Able | 81/478 |
| 4,314,490 | 2/1982 | Stone | 81/479 |
| 4,328,709 | 5/1982 | Schramm | 81/479 |
| 4,558,601 | 12/1985 | Stasiek | 73/1 C |

*Primary Examiner*—Frederick R. Schmidt
*Assistant Examiner*—Bradley I. Vaught
*Attorney, Agent, or Firm*—Jacox & Meckstroth

[57] ABSTRACT

A torque wrench, basically exemplified by a torque beam having a driver at one end, a grip at its other end and apparatus associated with said driver and beam providing an observable read-out of any torque that may be developed during use of the wrench, particularly distinguished by a system for defining a prescribed torque limit in use thereof having means associated therewith for producing a highly distinctive alarm signal the nature of which is such to produce an instantaneous torque limiting response of the user at precisely that time the level of the torque applied to said beam reaches said prescribed limit. In a preferred embodiment the system for producing said signal is located in connection with a housing which is releasably based on and secured to said beam immediately of its grip, the means through which the signal is triggered is functionally related to a portion of said read-out apparatus and the alarm signal is preferably provided by a source of light and optionally by a source of sound.

14 Claims, 6 Drawing Figures

20
22
24
28
26
30
10
12
40
44
77
46
48
49
38
76
55
57
56
78
58
59
42
51
76
60
14
13
16

40
44
46
80
77
72
62
65
48
66
54
76
38
56
52
64
20
32
22
34
18
58
16
13
14
11
30
71
68
79
36
24
10
12
28
26
61
60

53
51
55
57
76
58
70
80
78
51
63
72
66
38
18
14
16
13
20
30
10
64
62
68
78
65
76
69
73
56

TORQUE WRENCH WITH AUDIO AND VISUAL INDICATOR

BACKGROUND OF THE INVENTION

This invention relates to torque wrenches and more particularly to improvements in such devices which render them not only most simple and economical to fabricate and devoid of complexity yet endow them with features of utility equal to and beyond those of the wrenches considered as the "Cadillacs" of the prior art which are much more expensive and involved as to their construction. In this context, the embodiments of the present invention may be further characterized as being more efficient and satisfactory in use in a wider variety of applications and environments and affording an operator self insurance against excessive application of torque in their use.

A torque wrench is used in application to fastening devices in the nature of bolts, nuts, screws and the like to insure a tight application thereof while avoiding the application thereto of excessive torque, the latter being adverse to and sometimes destructive of the structural integrity of the fasteners and/or the elements which they are intended to clamp or otherwise fix in place.

Applying a uniform level or torque to each of a number of fasteners required to achieve a given assembly of parts, let alone insuring adequate and avoiding excessive application of torque to any single fastener is not always easy. This is not surprising considering the fact that the person using a hand tool such as a torque wrench must keep his mind and eyes on his work and the attitude of his tool in its application to avoid cocking of slippage and disengagement of the tool with possible damage to the work product or its parts and loss of time in the work procedure while at the same time observing read-out of the torque being applied, too little or excessive amounts of which are both unacceptable. Consider further that the user is never rigid and fixed as to his position while he works, by reason of which the problem of parallax enters into his efforts to accurately read the position of a pointer with reference to the torque scale he must observe. This problem is compounded where, as often is the case, the position and location of the user of the torque wrench relative to his work or the environment in which he is working makes it inconvenient or even impossible to readily observe a torque read-out device while he is fixing a fastener in place.

Some torque wrenches of the prior art have endeavored to avoid problems of the nature described above by ignoring the need for the convenience and savings inherent in the provision of a simply constructed and arranged torque read-out means and concentrating on providing complex and costly torque limiting and disabling means within the wrench. However, this is obviously not the best solution and does not afford the required versatility and simplicity and economy of design and use that is most desirable and made possible by the present invention.

The prior art most pertinent to the present invention, as far as those substantively involved in the preparation of this disclosure are aware, is exemplified by the attached exhibit, namely as catalogue sheet of Saint-Chi Industries Co., Ltd., which reveals a torque wrench comprising a handle having a grip at one end and a driver at the opposite end, the driver mounting an indicator rod which projects over the handle in the direction of its grip to have the projected extremity of the rod applied to a scale imprinted on a flat horizontal plate located transversely of and in connection with the handle, immediately of the grip.

SUMMARY OF THE INVENTION

Embodiments of the present invention provide a torque wrench comprising a torque beam having a driver and read-out means in association therewith for reflecting torque applied during use thereof characterized by means operatively related to at least a portion of said read-out means to selectively establish a prescribed torque limit in use of the wrench having means operatively connected therewith to trigger a torque limiting reaction in the user of the wrench in an instantaneous response to the level of torque applied reaching said prescribed limit.

Another embodiment comprises a torque beam having a driver at one one end, a grip at its other end and apparatus associated with said driver and beam providing an observable read-out of any torque that may be developed during use of the wrench. In this instance the wrench is particularly distinguished by a system for defining a prescribed torque limit in use thereof having means associated therewith for producing a highly distinctive alarm signal the nature of which is such to produce an instantaneous torque limiting response of the user at precisely that time the level of the torque applied to said beam reaches said prescribed limit. In a preferred embodiment the system for producing said signal is located in connection with a housing which is releasably based on and secured to said beam immediately of its grip, the means through which the signal is triggered is functionally related to a portion of said read-out apparatus and the alarm signal is preferably provided by a source of light and optionally by a source of sound.

The invention embodiments feature an in depth consideration of human engineering and their construction affords a simplistic interrelation of components providing both continuous availability of optimally positioned and oriented read-out means while at the same time insuring against application of excessive torque. The net result is an ability to have a relatively inexpensive torque wrench that can be effectively and easily handled by a relatively inexperienced worker in a most efficient manner with an expenditure of a minimum amount of time for a given job and a highly satisfactory end product.

A primary object of the invention is to provide a new and improved torque wrench which is not only simple and economical to fabricate but also more efficient and satisfactory and more versatile in use and adaptable for use in a wider variety of applications and environments.

Another object is to provide a torque wrench enabling a more uniform and more controlled performance in applying fasteners, and correspondingly a high quality of the end products to which the fasteners are applied.

A further object is to provide a torque wrench in which the desired limit of torque applied in use thereof may be preset and assured.

An additional object is to provide a torque wrench in which the desire limit of torque applied in use thereof may be preset and assured by the inclusion therein of a new and improved signal head which provides an alarm signal the nature of which is such to produce a reactive easing off or the termination of the application of torque by the user in an instantaneous response to a reaching of said limit.

Another object of the invention is to provide a new and improved signal head for a torque wrench enabling an inherently controlled use thereof.

An additional object is to provide a new and improved torque wrench possessing the advantageous features, the inherent meritorious characteristics and the means and mode of application and use herein described.

An additional object is to provide a new and improved signal head for a torque wrench possessing the advantageous features, the inherent meritorious characteristics and the means and mode of application and use herein described.

Referring to the drawings which show some but not necessarily the only forms of embodiment and practice of the invention, FIG. 1 is a perspective view of a preferred embodiment of a torque wrench per the present invention which incorporates a new and imrpoved signal head;

Like parts are indicated by similar characters of reference throughout the several views.

DESCRIPTION OF THE ILLUSTRATED EMBODIMENT

Figure 1:
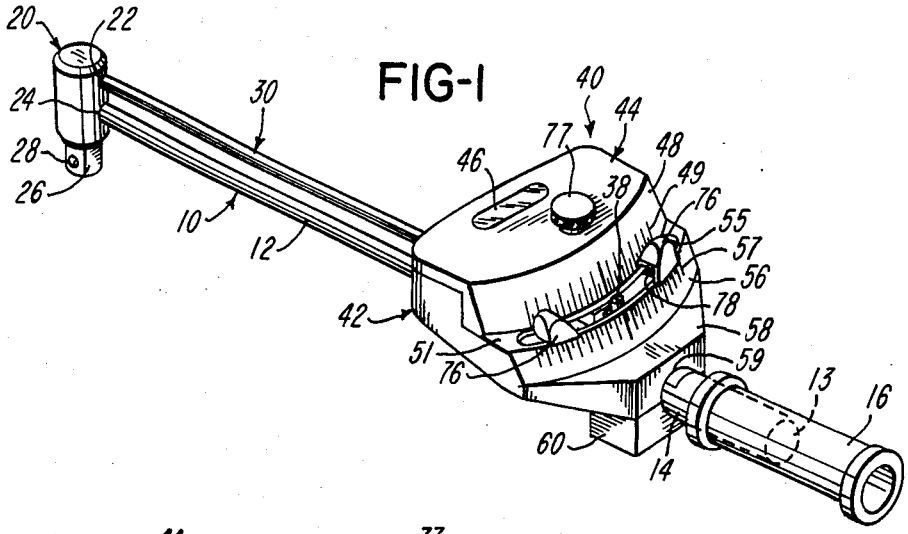

The embodiment of the invention herein illustrated basically comprises a torque beam 10, a driver 20, an indicator 30, a signal head 40 and torque limiting means 76,78.

The torque beam in this instance is in the form of a cylindrical rod the length of which is divided into two sections 12 and 14 and the respective ends of which are labelled in the drawings as 11 and 13. Each section 12 and 14 is uniform as to its diameter the length thereof but the section 14 which includes the end 13 has a diameter larger than that of the section 12, by reason of which its inner end defines an annular shoulder on the beam 10 which faces in the direction of the end 11.

The driver 20 comprises a short cylindrical head portion the diameter of which is larger than that of the section 12 of the beam 10. The driver head is formed to include two diametrically oriented, transversely extending through bores 22 and 24. The diameters of the bores 22 and 24 are respectively complementary to the diameters of the end 32 of indicator 30 and the end 11 of the beam 10.

As will be seen from the drawings, the indictor 30 also has a rod form the diameter of which is uniform the length thereof, but considerably smaller than that of the section 12 of the beam 11.

The driver 20 further comprises a coaxial generally rectangular extension 26 which is integral with, projects from and perpendicular to one end surface thereof which is perpendicular to its longitudinal axis. One longitudinally extending side face portion of the extension 26 incorporates a conventional spring biased ball type snap fastener, the ball of which has a limited projection therefrom, by means of which a socket suited for the application of the torque wrench at any given time, with or without a further extension, may be connected with a snap fit to and for rotation with the driver 20.

The length of the rod defining the indicator 30 is somewhat less than that of the section 12 of the beam 10 and in its attitude shown in the drawings it is directly above the beam. Further discussion of these parts and those which are interrelated therewith will consider them in this frame of reference. It should be obvious, however, that this is not by way of limitation but merely a matter of convenience for purpose of this disclosure.

The beam 10, anchored at one end 11 in the bore 24, projects from and in a line radially of and perpendicular to the longitudinal axis of the driver 20. The rod 30 similarly anchored at its end 32 in the bore 22 projects outwardly therefrom in a line radially of and perpendicular to the same axis of the driver and disposes, to the extent of its length, directly over and in a closely spaced parallel relation to the section 12 of the beam 10. As will be obvious, the projected extremity of the rod 30 positions short of the annular shoulder which defines the inner end of the beam section 14.

The projected extremity of rod 30 is lodged in a blind bore in one end of a small rectangular block 34 to which it is fixed by set screws 36. At the opposite end of the block 34, which provides an axial extension of the projected extremity of the rod 30, adjacent its upper edge as seen in the drawings, is a flat plate-like axial projection fixed to which is a relatively short perpendicularly related upwardly projected pin 38. The purpose and function of this pin which is located immediately of an in a radially outward, closed spaced, relation to the annular shoulder portion of the beam section 14 will soon be obvious.

A locator pin 18 is anchored in and projected radially from and upwardly of the upper surface of the beam section 14, in a laterally centered relation thereto at a point adjacent and in a relatively closely spaced relation to the pin 38. The extent of the projection of the pin 18 is quite limited but it is in line with and parallel to both the pin 38 and the head of the driver 20. The end portion of the beam section 14 outwardly of and in a longitudinally spaced relation to the pin 18 mounts thereon, in a securely connected relation thereto, a portion of the length of a sleeve formed grip 16 the remainder of which projects outwardly beyond and provides a short axial extension of its end 13.

The signal head 40 comprises a housing including a plate-like base 51. The upper surface of what may be considered the rearmost part of the base 51 is planar in character, has parallel side edges, a rearmost edge which is slightly arcuate and symmetrically convex in configuration and a forward edge which is also arcuate, symmetrically convex and formed on a uniform radius the dimension of which is smaller than that on which the rear edge is formed. An arcuate slot 55 is formed in said rearmost part of the base 51 immediately at, to the rear of, parallel to, almost coextensive with and centered with reference to said forward edge thereof.

A four sided integral wall structure rises upwardly from and perpendicular to the upper surface of said planar portion of the base 51 to define therewith a shallow receptable 42.

The rear side portion 42 of said wall structure is along and coextensive in length with the rear edge of the base 51 as it rises upwardly therefrom and perpendicular thereto. Its forward side portion rises upwardly from and perpendicular to the base 51 to extend from side to side thereof at a location adjacent and in a reardwardly spaced relation to the slot 55. By virtue of the fact that in top plan view said front side has a convexly curved configuration identical to that of the forward edge of said rearmost portion of the base 51 and the slot 55, it is parallel thereto. The lateral sides of the wall structure respectively join adjacent lateral extremities of the sides 52 and 53 and are similarly integrated with the portions of the base 51 thereunder. The forward side of said wall structure has a shallow rectangular notch formed in the upper edge of its centered apex portion and its outer surface 53 has thereon a shallow rectangular projection 54, spaced immediately under and parallel to the base of said notch, which is slightly extended in a lateral sense and parallel to the upper surface of the portion of the base 51 thereunder.

The forward edge of the rearmost portion of the base 51 just described is forwardly extended by a downwardly and forwardly inclined skirt portion 56 which is laterally coextensive therewith and embodies on its outer surface a conventional torque scale 57 the upper limits of the markings of which are immediately of the forward edge of the slot 55. The forwardmost portion 58 of the base 51, the rearmost edge of which is joined coextensively to the lower edge of the skirt portion 56, is bent to orient its upper surface in a plane which is in a parallel spaced relation to that of the upper surface of the rearmost part of the base. The lateral sides of the portion 58 are symmetrically convergent from the lateral extremities of the skirt 56.

Integrated with and dependent from the undersurface of the forward portions 56 and 58 of the base 51 is a saddle structure in the undersurface of which is formed a hemicylindrical groove 59 which is laterally centered, extends from front to rear thereof and has a radius complementary to that of the section 14 of the beam 10. Centered in the surface bounding the groove 59 is a shallow blind bore complementary in dimension to that of the pin 18 which it accommodates as this saddle and the structure and elements interconnected therewith are mounted to what may be considered the upper half of that end portion of the section 14 of the torque beam 10 including its annular shoulder. A clamping block 60 having a shape to embody in its upper surface a hemicylindrical groove complementary in shape to the groove 59 in said saddle is applied to the lower half of the section 14 directly under the saddle and secured in fixed relation thereto by screws 61. By virtue of this arrangement the housing of the signal head 40 is clamped over and to the beam 10 in an adjacent closely spaced relation to the grip 16 with its rearmost portion over and in an elevated spaced relation to that end portion of the section 12 which joins the section 14 of the beam. In the process of the assembly of the signal head 40 to the beam 10 the pin 38 of the indicator rod assembly is projected up into the slot 55 and laterally centered with reference thereto and the torque scale 57, immediately adjacent the markings of the latter. The upper surface of the pin 38 has a diametral groove which in the function thereof aligns with the markings of the torque scale 57.

The housing of the signal head 40 including the receptacle 42, its cover 44 and their interconnected parts afford means for a creation therein and an application thereto of an exceedingly simple and inexpensive circuit means incorporating an alarm the construction and arrangement of which is such to surely and precisely function to produce an instantaneous reaction causing the user to reduce or terminate the application of torque at that moment it reaches a prescribed limit, irrespective of visual access, or lack thereof, to the torque scales embodied as part of said housing. Simple means forming part of the control circuit are utilized to preset a selected torque limit to suit a particular application of the wrench.

Within the receptacle 42 the forward and rear side portions 53 and 52 of its bounding wall structure are centrally bridged by a pair of parallel, closely spaced partitions 63 and 68 which are in planes which laterally bound the notch centrally of the upper edge of the forwardmost wall portion 53. Fixed to and projecting upwardly from and perpendicular to the base of the receptable 42, centered between said closely spaced partition walls and immediately inward from said notch, is a threaded stud 79 the length of which is such that it projects upwardly and outwardly from said receptacle. At a location spaced slightly to the rear of the stud 79 the immediately facing surfaces of said parallel partitions have aligned vertically extending projections the upper limits of which commonly lie in a plane parallel to the base of the receptacle. These last mentioned projections provide abutment means against which an intermediate portion of the length of a strip 65 of copper sheet material located between said partitions bears as it rises upwardly from and perpendicular to the base of the receptacle 42 and is extended over the tops of said projections. The strip 65 is continued forwardly, between said partitions, from said tops of said projections to and through said notch. In the process this end portion of the strip 65 is upwardly inclined to a slight degree, sufficient to give it a spring biased effect and have the projected extremity 66 thereof, which is narrowed and angled forwardly and downwardly for a very short distance beyond said notch, positioned outwardly of said receptacle in an overlapping spaced relation to the upper portion of the surface 53, immediately above the projection 54. The opposite end of the strip 65 is directed rearwardly between said partitions on the base of the receptacle and extended by means of an interconnected conductively related strip 64 of the same material to its rear wall portion 52. The strip 64 has a laterally projected extension bent upward therefrom and perpendicular to the base 51 to bear on and bias against the portion 62 of the partition wall 68, which is to the left thereof when viewing the interior of the receptacle from its forward limit. A notch directed inwardly of the upper edge of this lateral extension of the strip 64, in a laterally centered relation thereto and almost to its base, aligns with a corresponding notch defined in the rear end portion 62 of the partition 68 against which said lateral extension bears. Means formed integral with and rising upwardly from and perpendicular to the base of the receptacle in a plane parallel to and spaced directly to the left of the partition portion 62 defines a notch identical to that in the partition portion 62 and aligned therewith.

Each of the partitions 63 and 68 has a deep notch therein centrally of its length which opens from its top edge. These notches form saddles affording positioning means for a pair of slim flashlight type batteries 80 disposed in said receptacle 42 in end abutting relation to extend across its interior from essentially one lateral extremity thereof to the other. The remote extremities of these batteries are contained and respectively engaged by biased contact end portions of further strips of conductive material, respectively 69 and 70, which are suitably anchored to the base 51.

A battery light 72 the cylindrical metal base of which has a conventionally formed external flange immediately of the base of its bulb is mounted in said receptacle by seating it in the saddle defined by the notch in the lateral extension of the strip 64 and the notch in the portion 62 of the partition 68 against which said lateral extension is biased, in the process of which a portion of said flange is slipped between said lateral extension of the strip 64 and the partition portion 62 and held in place by the bias of said lateral extension. The bulb is thereby securely mounted to project the contact end of its base through the means defining the third aligned notch to the left of the partition portion 62 and have a biased engagement thereto of a conductively related contact provided at that end of the strip 69 remote from its end which makes contact with a battery 80.

The strip 70 is anchored to the base 51 of the receptacle 42 by a metal conductively related stud which projects through one end of a further coppper strip 71 and anchors it to the underside of the base. The strip 71 is suitably guided over the underside of the base 51 in a protected insulated manner to have its opposite end threaded through an opening in the saddle dependent from the base 51 to contact and continuously bear against the steel material of which the beam 10 is fabricated, adjacent the inner end of its section 14.

Figure 2:
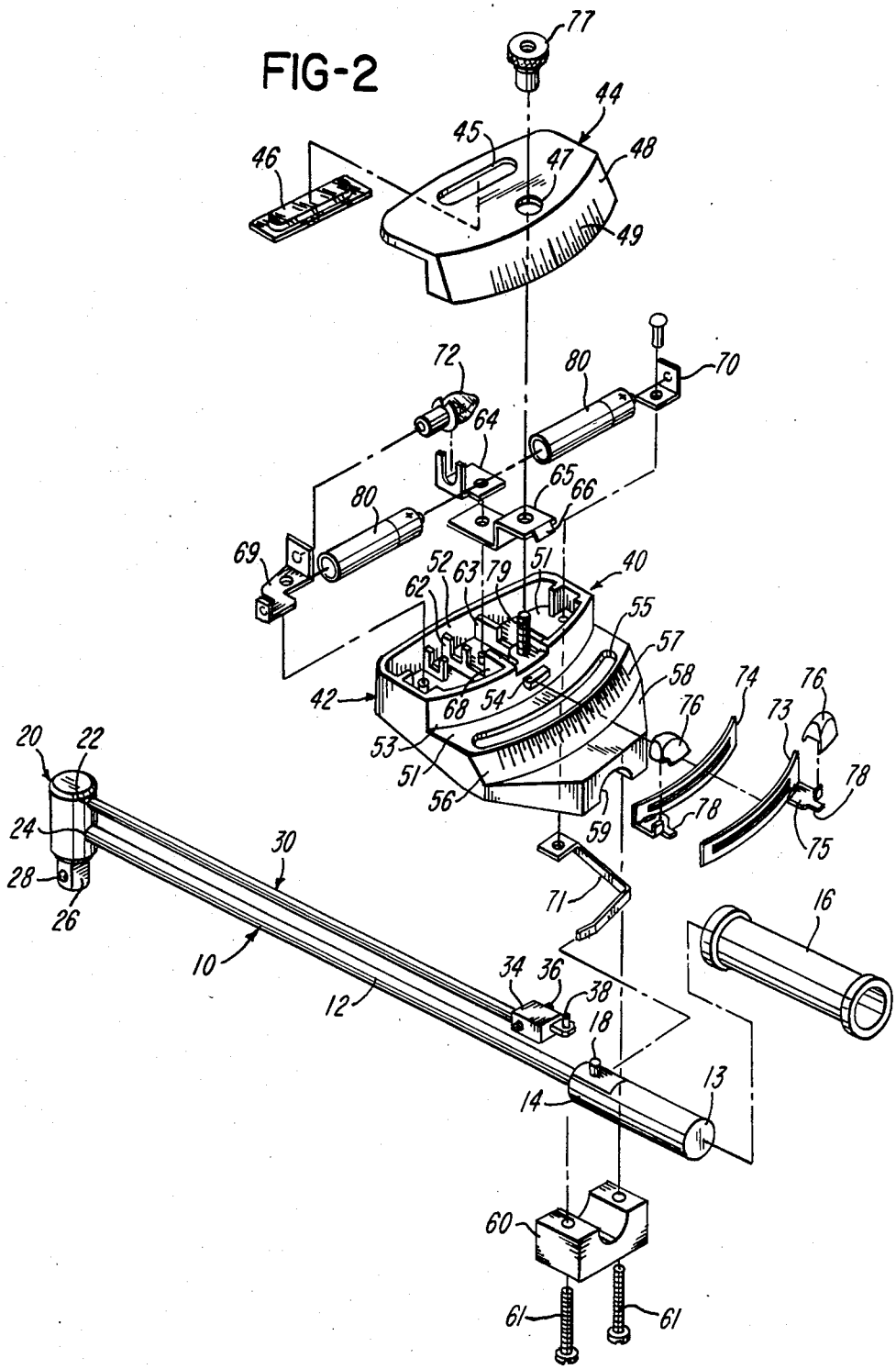
FIG. 2 is an exploded view of the structural assembly of FIG. 1.

In addition to the above described strips of copper, there are two substantially identical rectangular strips 73 and 74, made of a conductive bronze material, which from end to end thereof are each formed as an arc having the same uniform radius as the forwardmost side wall surface portion 53 of the receptacle 42. Each of the strips 73 and 74 has therein an identical centered longitudinally extending slot running almost the length thereof in a line parallel to its upper and lower edges. Each of the strips 73 and 74 also has a short tab-like projection 78 which is integral with its lower edge at one end thereof and projects outwardly of and at a right angle to what may be considered its forward surface. The only difference between the strips, as seen in FIG. 2, is that the projection 78 on the strip 74 is at its left end and that on the strip 73 at its right end. In the assembly of the strips 73 and 74, the strip 74 is so applied to the forward surface 53 of the wall structure of the receptacle 42 as to accomodate the projection 54 in its slot, which is complementary in dimension to that of the projection 54, so the material of the strip at the upper and lower edge of the slot may bear thereon and the strip may be guided thereby in a movement thereof laterally of the surface 53 as and for purposes to be further described. The strip 73 is similarly applied, but in a manner to have one end portion thereof remote from its projection 78 overlap the corresponding end portion of the strip 74 and likewise accommodate the projection through its slot of the outer end portion of the projection 54.

As will be obvious, on a bearing containment of the partially overlapped strips 73 and 74 to each other and the surface 53 their tabs 78 are at their remote ends and positioned immediately forward of the surface 53 in an essentially parallel relation to the base 51 with their projected end portions immediately over and bridging the slot 55. Said projected end portion of each of the tabs 78 has an insulating plastic knob 76 adhesively secured in capping relation thereto, not only to facilitate the manipulation of the strip of which it forms a part but also, as will be obvious, to provide an insulator between the strip and the user. Particular attention is directed to the fact that the form and application of the knob 76 in each case is such to provide that the most adjacent edge portions 75 of the tabs 78 are left in an exposed facing relation, in line with the upper end portion of the pin 38 which projects through and slightly upward of the slot 55 when the signal head 40 and its associated elements are clamped to the beam 10.

The assembly of the housing of the signal head 40 is completed on the capping of the receptacle 42 by its cover 44. The cover 44 includes a plate portion having a planar configuration which bridges the upper limits of the bounding wall structure of the receptacle 42 and has a skirt formed integral with its forwardly positioned edge which depends to the the base 51 to overlie, position immediately forward of and cap the forward limit of the receptacle wall structure and the elements which mount thereto. Sufficient space is left between the lowermost edge of this skirt and the base 51 to permit free lateral movement therebetween of underlying portions of the forwardly projected tabs 78 of the strips 73 and 74. As will be seen in the drawings, the forward and outer surface 48 of the skirt portion of the cover 44 is forwardly and downwardly inclined and from one lateral extremity to the other is formed on an arc corresponding to that of the surface 56. In its assembled position the surface 48 has its lower forward edge portion immediately to the rear of the rear edge of the slot 55 and parallel thereto and immediately to the rear of the knobs 76. That portion of the cover 44 which caps the upper edges of the receptacle wall structure embodies therein an aperture 47 which is laterally centered and located immediately to the rear of the forward edge thereof to accommodate the projection therethrough of the upper end portion of the stud 79 as the cover is assembled. A nut 77 is applied to that portion of the stud 79 which projects above the cover. On an appropriate adjustment of the nut 77 on the stud 79 the cover 44 is clamped over the receptacle and fixed in place.

On turning the nut down further than required to merely clamp the cover in place, sufficient pressure is exerted on that portion of the cover thereunder, which is immediately about the stud, to cause the portion 66 of the conductive strip 65 to be pressured down and over the overlapped portions of the conductive strips 73 and 74 to fix them in the positions in which they are respectively set at that time. It should be obvious from the foregoing as to how the strips 73 and 74 may be selectively and optionally fixed in place and at the same time conductively related to the strip 65 or in the alternative made free of and disconnected from the strip 65 leaving the strips 73 and 74 still contained but released so that one or both may be slid laterally of the other through the medium of the interconnected knobs 76 and with reference to the markings of the scale 57 to selectively set the exposed edge of the tap 75 of the manipulated strip in line with a marking on the scale designating a specific torque the application of which is to be the permissible limit in use of the wrench, for a given application thereof. One or both of the tabs 75 may be appropriately so set, depending on whether the application of the wrench of which they form a part requires only rigt or a left hand rotation in use thereof or both. In any event a specific torque limit may be simply and positively set as and to the extent prescribed for the application of the wrench.

The construction and arrangement is such that when the tab 75 of one of the strips 73, 74 has its exposed edge aligned with that scale marking defining the prescribed torque limit and there fixed by the appropriate tighening down of the nut 77 on the cover 44, the clamping of the end portion 66 of the strip 65 over the portions of the strips 73 and 74 thereunder insures that a signal circuit is made available which is completed when the degree of application of torque in using the wrench is such that the stress and resulting bending evidenced in the beam causes the signal head 40 connected therewith to bring the exposed edge of the referenced tab 75 into contact with and in conductive relation to the portion of indicator pin 38 in its path. At precisely that moment in which this occurs the circuit shown in the drawings is completed and simultaneously there is an instantaneous flash of the light 72 which, irrespective of the position of the eyes of the user of the wrench at that moment, will produce an inherently instantaneous reaction of the user in the form of a let down or a termination of the torque being applied to the wrench. As should be obvious from a human engineering standpoint, the construction and arrangement precludes the natural human inertia of the great majority of people who might use such a wrench and avoids excessive torque and the undesirable consequences thereof which have been above set forth in the first instance.

Figure 3:
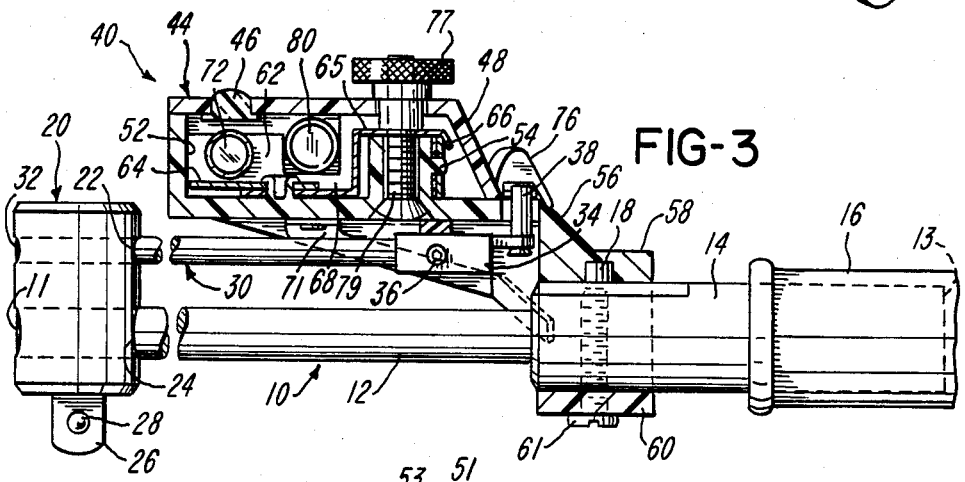
FIG. 3 is a fragmentary side elevation view of the assembly of FIG. 1 shown partly in section.
Figure 4:
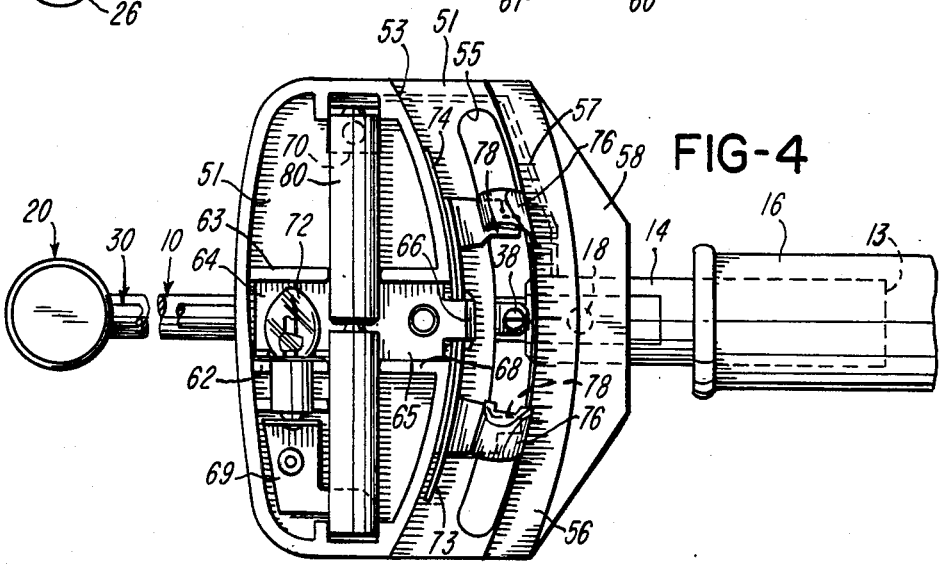
FIG. 4 is a top view of that structure shown in FIG. 3, with the cover of the housing of the signal head portion thereof removed.
Figure 5:
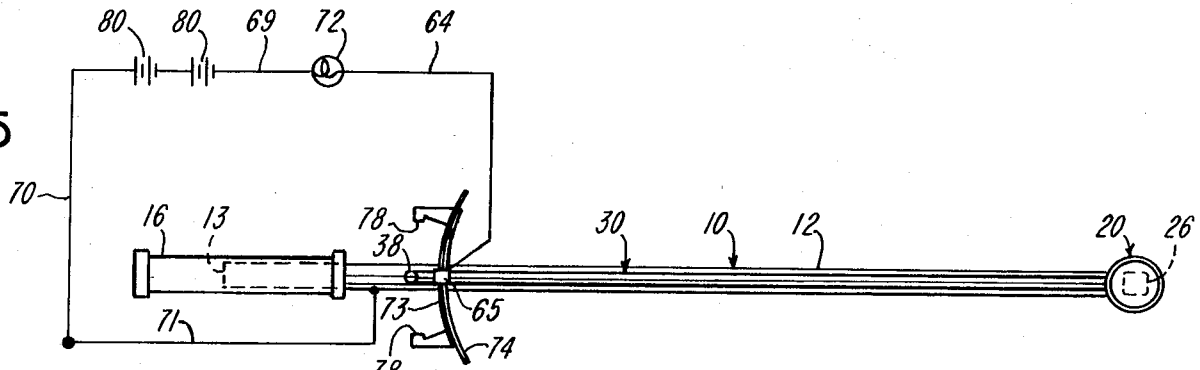
FIG. 5 is a view of the torque beam, the driver and the indicator rod of the torque wrench, illustrated in absence of applied torque, together with a schematic of the circuit of the alarm portion of its signal head.
Figure 6:
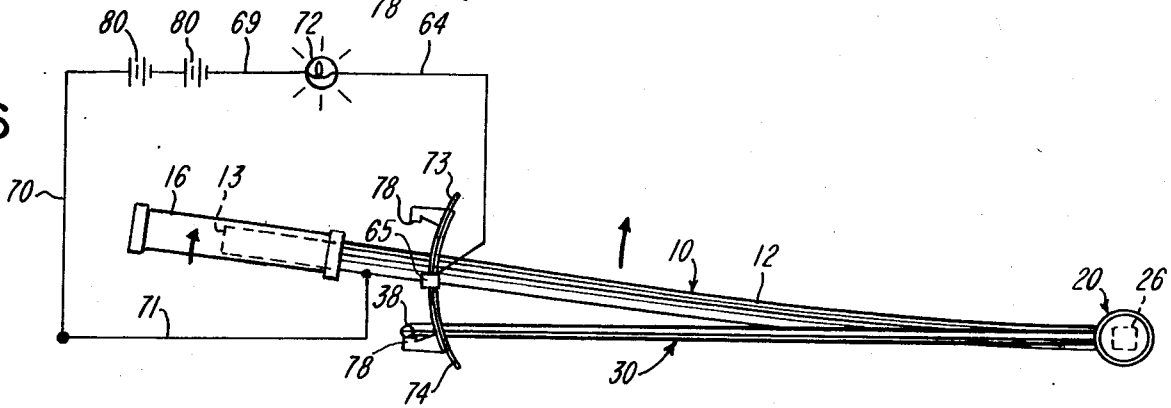
FIG. 6 is a view of the same components of the torque wrench as shown in FIG. 5 wherein the torque beam component thereof exhibits the application of torque.

The circuit which triggers the flashing on of the light 72 is schematically exemplified in FIGS. 5 and 6 of the drawings. The elements of conductive material of which the circuit is comprised, as herein illustrated, may be seen in detail in FIGS. 2–4 of the drawings. As should be self evident, there is no polarity involved. The strip 71 is in continuous conductive contact with the beam 10 and, by way of ground contact 70, conductively related to the coupled batteries 80 the remote end of which is in conductive contact with the strip 69 conductively related to and through the base of the bulb 72, by way of the strips 64, 65 and the strip extremity 66, to the strips 73 and 74 when the portion 66 is clamped over the strips 73 and 74. The indicator pin 38 is in turn conductively related to the beam 10 by virtue of its connection thereto by way of the driver 20. As the circuit is thus provided, it is closed as contact is effected between the indicator pin 38 and an exposed edge of a tab portion 75 of one of the strips 73 or 74.

The nature and interrelation of the circuit elements and the manner in which they are incorporated in and with reference to the signal head as herein illustrated is such as to insure against inadvertent and accidental damage thereto in use of the wrench. The construction provided is essentially maintenance free and will perform accurately and, as herein set forth, irrespective of the direction in which the wrench must be turned in use thereof and irrespective of the position of the user with respect to the wrench. In any case the alarm signal utilized will be such to induce the instantaneous reaction of the user precisely at that moment it is energized simultaneous with an application of torque reaching that level which is the prescribed limit in use of the wrench.

It may be desired, in some cases, that means for producing a distinctive sound be used to produce the alarm signal rather than a light emitting device. In such case a known device capable of producing such a sound may be inserted in the described circuit in place of the light 72. In should also be obvious, if so desired, that such a sound emitting device may be series related to the light 72 within the described circuit, thereby producing an ultimate combination for use in triggering an instanteous reponse of the user of a torque wrench embodying features of the present invention. These modifications may be achieved in a manner believed so obvious as to require no further discussion in this respect.

As herein illustrated the cover 44 is provided with an aperture directly above the bulb of the light 72. Fixed across this aperture is a lens 46 which highlights the flash of light emitted from the bulb and the signal head as the circuit in which the light is embodied is closed.

Furthermore, a metric torque scale 49 applied to the forward surface 48 of the skirt portion of the cover 44 has the markings thereof referenced to the groove in the upper end of the indicator pin 39 in the same manner as the U.S. torque scale 57. Particular attention must be directed to the offset inclined attitudes of the torque scales on the surfaces 48 and 56, with reference to the base 51 which greatly facilitates the reading of such torque as is reflected by the read-out means as here provided and insures a much greater accuracy in a direct reading than heretofore provided by devices of the prior art.

It should be self evident that the signal head of the invention and the composition thereof per se is unique in and of itself and provides a most inexpensive means and mode of embodying a provision for more accurate torque read-out as well as means for insuring against the occurence of excessive torque in a simple wrench construction.

From the above description it will be apparent that there is thus provided a device of the character described possessing the particular features of advantage before enumerated as desirable, which obviously is susceptible of modification in its form, proportions, detail construction arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A torque wrench comprising a driver, an elongated torque beam having opposite end portions, one of said end portions secured to said driver, handle grip means secured to the other said end portion of said torque beam, an elongated indicator rod having opposite end portions, one of said end portions of said indicator rod secured to said driver and positioning said indicator rod generally parallel to said torque beam, a signal unit carried by said other end portion of said torque beam and receiving the other said end portion of said indicator rod, said signal unit including a housing having an arcuate surface extending laterally across said torque beam, a graduated scale on said arcuate surface for indicating both clockwise torque and counter-clockwise torque applied to said driver with said torque beam, an arcuate electrical contact member for clockwise torque and a separate arcuate electrical contact member for counter-clockwise torque, said housing having an arcuate support surface supporting said contact members in adjacent overlapping relation, means adjacent said scale for independently adjusting each of said contact members laterally along said support surface for selecting a predetermined corresponding torque, an indicator alarm adapted to be actuated by a battery power supply, electrical circuit means for connecting said alarm to the battery power supply through said torque beam and said indicator rod and through both of said contact members, and means on the other said end portion of said indicator rod for contacting either of said contact members at the preselected torques on said scale to complete an electrical circuit to said alarm in response to bowing of said torque beam and corresponding lateral movement of said scale and said contact members to provide an indication when either clockwise torque or counter-clockwise torque reaches the corresponding preselected torque.

2. A torque wrench as defined in claim 1 wherein each of said contact members includes a portion projecting to said scale to provide said adjusting means, and said means on said indicator rod comprise an electrical conducting element projecting to said scale between said portions of said contact members.

3. A torque wrench as defined in claim 1 and including clamping means for releasably securing said contact members to said support surface after said contact members are adjusted laterally to the preselected torques.

4. A torque wrench as defined in claim 1 wherein said housing defines and arcuate slot extending adjacent said scale, and said contact members include corresponding portions projecting into said slot to provide for adjusting said contact members.

5. A torque wrench as defined in claim 4 wherein said means on the other said end portion of said indicator rod comprise an electrical conducting element projecting into said slot between said corresponding portions of said contact members.

6. A torque wrench as defined in claim 4 wherein said housing has a second arcuate surface adjacent said slot and supporting a second arcuate graduated scale, and said adjusting portions of said contact members are disposed between said scales.

7. A torque wrench as defined in claim 1 wherein said housing defines a chamber for receiving a pair of cylindrical batteries in axial alignment extending laterally with respect to the torque beam, and said alarm comprises a light bulb within said housing.

8. A torque wrench comprising a driver, an elongated torque beam having opposite end portions, one of said end portions secured to said driver, handle grip means secured to the other said end portion of said torque beam, an elongated indicator rod having opposite end portions, one of said end portions of said indicator rod secured to said driver and positioning said indicator rod generally parallel to said torque beam, a signal unit carried by said other end portion of said torque beam and receiving the other said end portion of said indicator rod, said signal unit including a housing having a support surface extending laterally across said torque beam and means forming a graduated scale extending laterally across said torque beam for indicating both clockwise torque and counter-clockwise torque applied to said driver with said torque beam, an electrical contact member supported by said support surface for clockwise torque and a separate electrical contact member supported by said support surface for counter-clockwise torque, means for independently adjusting each of said contact members laterally adjacent said scale for selecting a predetermined corresponding torque, means for releasably securing said contact members to said support surface after said contact members are adjusted laterally to the preselected torques, an indicator alarm adapted to be actuated by a battery power supply, electrical circuit means for connecting said alarm to the battery power supply through said torque beam and said indicator rod and through both of said contact members, and means on the other said end portion of said indicator rod for contacting either of said contact members at the preselected torques on said scale to complete an electrical circuit to said alarm in response to bowing of said torque beam and corresponding lateral movement of said scale and said contact members to provide an indication when either clockwise torque or counter-clockwise torque reaches the corresponding preselected torque.

9. A torque wrench as defined in claim 8 wherein said securing means comprise an electrical conductive element forming part of said circuit, and threaded means for clamping said element against said contact members.

10. A torque wrench as defined in claim 8 wherein said housing defines a chamber for receiving said alarm and the battery power supply, and an electrical conducting member for connecting the battery power supply to said torque beam.

11. A torque wrench as defined in claim 8 wherein said housing defines an arcuate slot extending adjacent an arcuate viewing surface, said scale being disposed on said viewing surface, and said contact members include corresponding means projecting through said slot to provide for adjusting said contact members.

12. A torque wrench as defined in claim 11 wherein said means on the other said end portion of said indicator rod comprise an electrical conducting element projecting into said slot between said corresponding adjusting means on said contact members.

13. A torque wrench as defined in claim 11 wherein said housing has a second arcuate surface adjacent said slot and supporting a second arcuate graduated scale, and said adjusting means on said contact members are disposed between said scales.

14. A torque wrench as defined in claim 8 wherein said housing defines a chamber for receiving a pair of cylindrical batteries in axial alignment extending laterally with respect to the torque beam.

* * * * *